US005456168A

United States Patent [19]

Lewis

[11] Patent Number: 5,456,168

[45] Date of Patent: Oct. 10, 1995

[54] QUICK-CHANGE STAMP DEVICE

[76] Inventor: Ronald O. Lewis, 9535 Daniels Rd., Seville, Ohio 44273

[21] Appl. No.: 270,459

[22] Filed: Jul. 5, 1994

[51] Int. Cl.[6] ..... B31F 1/07

[52] U.S. Cl. ..... 101/32; 101/29

[58] Field of Search ..... 101/3.1, 16, 28, 101/29, 30, 31, 32

[56] References Cited

U.S. PATENT DOCUMENTS

| | | | |
|---|---|---|---|
| 1,259,238 | 3/1918 | Hudspeth | 101/28 |
| 1,919,363 | 7/1933 | Fowler . | |
| 1,987,370 | 1/1935 | Pleger | 101/9 |
| 2,089,794 | 8/1937 | Hauer | 101/28 |
| 2,333,716 | 11/1943 | Hammett | 101/28 |
| 2,872,861 | 2/1959 | Smith et al. | 101/27 |
| 3,085,508 | 4/1963 | Hurwitz | 101/384 |
| 3,762,484 | 10/1973 | Speicher | 101/3.1 |

*Primary Examiner*—Ren Yan
*Attorney, Agent, or Firm*—Roger D. Emerson

[57] ABSTRACT

The marking device for marking indicia onto manufactured parts includes a body portion having a recess. Into the recess and the body portion fits a stamp retainer block which also has a recess. Into the recess on the stamp retainer block fits type members which create the indicia on the manufactured part. Such indicia might be the part number or date of manufacture, or other such information useful in the manufacturing process. A second stamp retainer block may be advantageously utilized, by loading a second set of type members into the second stamp retainer block so that the first stamp retainer block can be quickly removed and the second stamp retainer block quickly inserted into the body portion of the marking device. Such insertion may be done by inserting a rod into a channel and depressing a spring loaded ball.

8 Claims, 3 Drawing Sheets

QUICK-CHANGE STAMP DEVICE

BACKGROUND OF THE INVENTION

1. Field of Invention

This invention pertains generally to the art of devices for marking indicia on metal parts, such as marking dies and more specifically to a method and apparatus for quickly and safely changing the dies.

2. Description of Related Art

Some manufacturing processes require the manufactured parts to be marked with identifying indica such as shift numbers or manufacturing dates. Such markings are sometimes made by striking a marking die against the part being manufactured. When the indica to be marked on the parts changes, such as when a run number must be changed, the marking die itself must be changed. Since the marking die is often located within a large machine, such as a stamping press, changing the indica creating portion of the marking die can be a time-consuming and risky process.

In U.S. Pat. No. 1,259,238 to Hudspeth, a type holder is described wherein individual type members are held into the recesses of a body portion by means of several ball and spring arrangements.

In U.S. Pat. No. 2,089,794 to Hauer, a die holder designed to be struck with a heavy hammer or sledge hammer is disclosed. The die holder features removable dies.

Both types of marking devices thus described allow for interchanging type members, but both also have drawbacks concerning simplicity and time constraints. When an operator changes marking dies, the machinery must be shut down and locked out. In some cases, the operator has some portion of his body between the jaws of the machine during the changeover. Therefore, an improvement in the changeover process could also provide increased worker safety.

The present invention contemplates a new and improved marking device which is simple in design, effective and overcomes the foregoing difficulties and others while providing better and more advantageous results.

SUMMARY OF THE INVENTION

In accordance with the present invention, a new and improved marking device construction is provided which allows for the quick and simple interchanging of marking indica.

More particularly, in accordance with the present invention, the marking device comprises a quick-change stamp retainer block used in combination with a main body portion. The body portion includes a recess into which the stamp retainer block is received. The body portion further includes a mechanism for locking the stamp retainer block in place. In one embodiment, the locking mechanism is a ball and spring.

According to another embodiment, the body portion further comprises an access channel to allow insertion of a rod to disengage the locking mechanism.

According to another aspect of the invention, the stamp retainer block has a machined dimple which provides an insert for the locking ball.

According to another aspect of the invention, the stamp retainer comprises a slot to hold individual type members.

In one embodiment, the stamp retainer is attached to the stamp retainer block by two set screws.

According to another aspect of the invention, a method of marking indica on a manufactured part and then quickly changing the indicia includes the steps of:

loading a first set of indica into a recess in a first stamp retainer;

fixing the first stamp retainer into a recess in a body portion of the marking device;

marking the associated manufactured part by bringing the first set of indicia into contact with a surface of the associated manufactured part;

removing the first stamp retainer block from the recess in the body portion;

loading a second set of indica into a recess in a second stamp retainer;

loading the second stamp retainer block into the recess of the body portion; and, marking a second associated manufactured part by bringing the second set of indicia into contact with a surface of the second associated manufactured part.

According to another aspect of the invention, the first stamp retainer block is removed by inserting a rod into an access channel of a the body portion of the marking device, thereby disengaging a ball and spring locking mechanism.

According to another aspect of the invention, step of loading a second set of indica into a recess in a second stamp retainer is performed while the first set of indicia is being used to mark the associated manufactured part.

One advantage of the present invention is the ability to quickly interchange marking indica on manufactured parts. The stamp retainer block can be removed easily by the insertion of a rod into a channel to disengage the locking mechanism.

Another advantage of the present invention is its simplicity of design. The locking mechanism engages or disengages the entire stamp retainer block through the action of one ball and spring combination.

Yet another advantage of the present invention is the opportunity for the operator to pre-stage a replacement stamp retainer/stamp retainer block combination. Another stamp retainer can be screwed onto a second stamp retainer block while the machine is operating. During changeover, the operator shuts down the machine and quickly interchanges the two stamp retainer blocks. The machine operator does not need to change individual type members nor unscrew the stamp retainer while the machine is shut down.

Still other benefits and advantages of the invention will become apparent to those skilled in the art upon a reading and understanding of the following detailed specification.

DESCRIPTION OF THE PREFERRED EMBODIMENT

Figure 1:
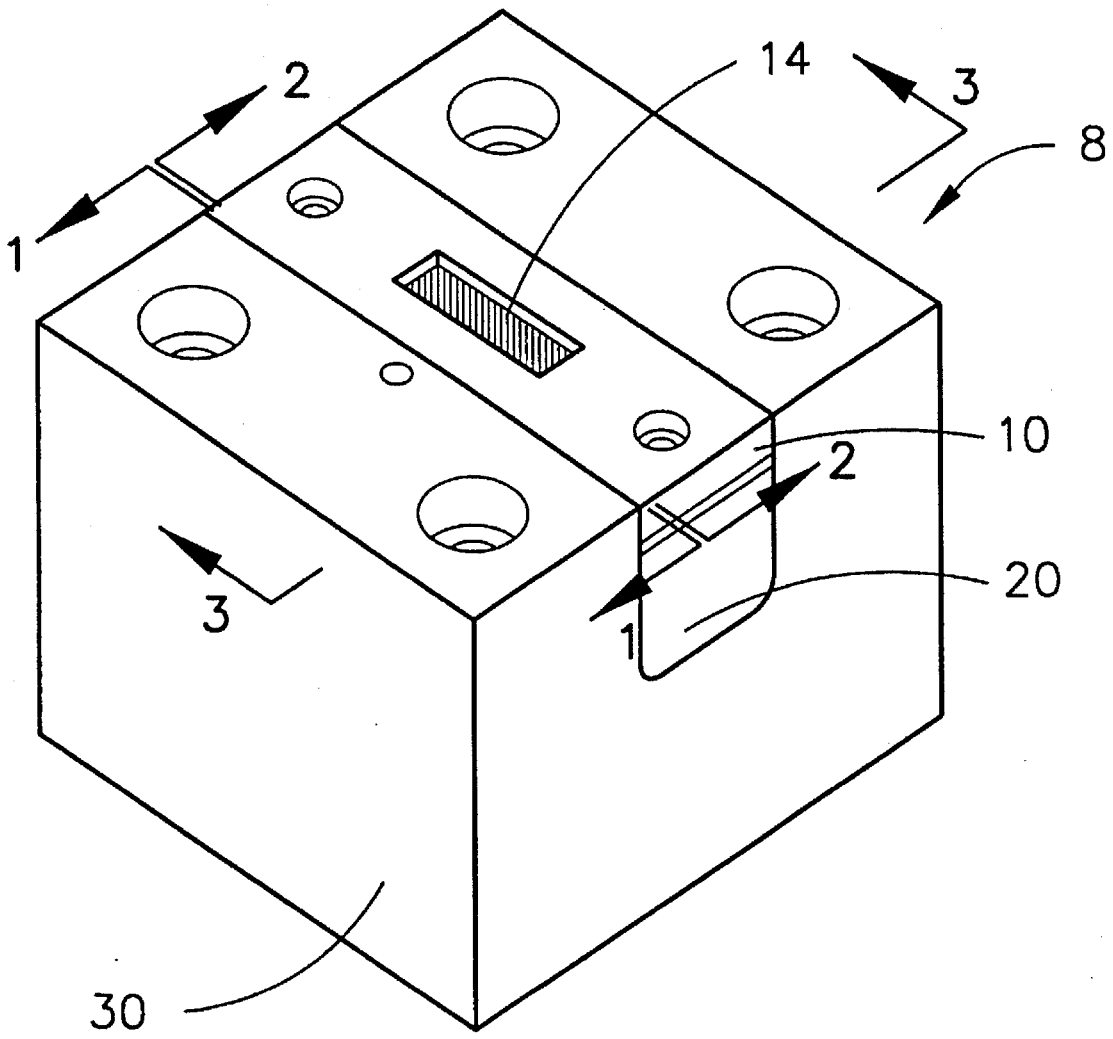
FIG. 1 is a perspective view of a marking device having a stamp retainer block fully engaged in the main body portion.
Figure 6:
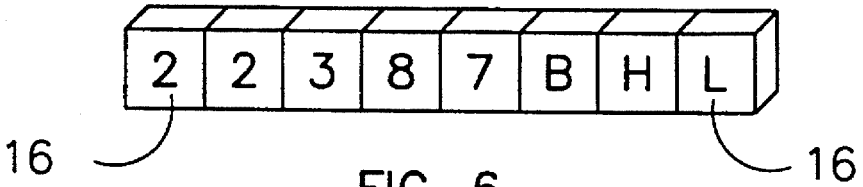
FIG. 6 is a perspective view of type members bearing indicia.
Figure 2:
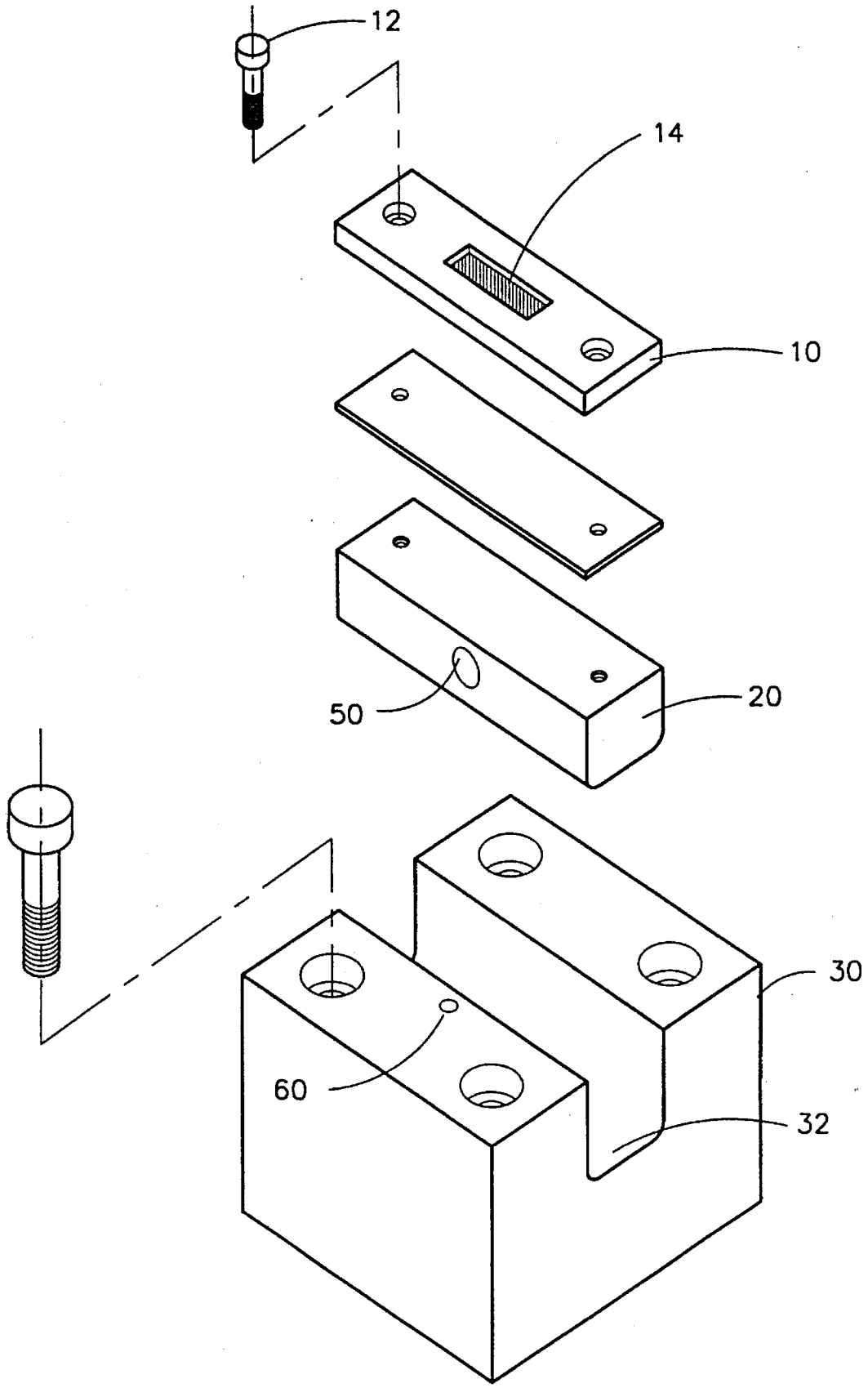
FIG. 2 is an exploded perspective view of the individual members of the marking device.

Referring now to the drawings, which are for the purposes of illustrating a preferred embodiment of the invention only, and not for purposes of limiting the invention, FIGS. 1 and 2 show a marking device 8 incorporating the present invention which includes a stamp retainer 10 which is attached by means of set screws 12 to a retainer block 20. The stamp retainer 10 includes a recess 14 to hold type members 16. The type members 16 bear indica such as letters and numbers which can be used to communicate information about the part being manufactured.

Figure 3:
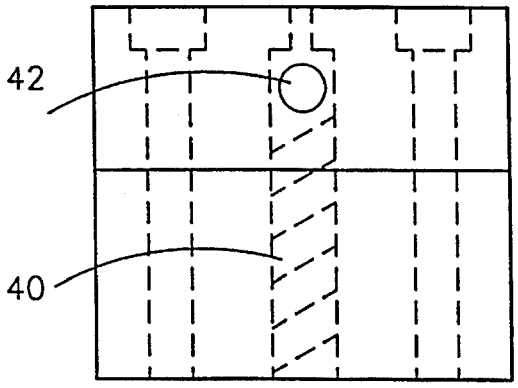
FIG. 3 is a cross-sectional view taken along line A—A of FIG. 1.
Figure 4:
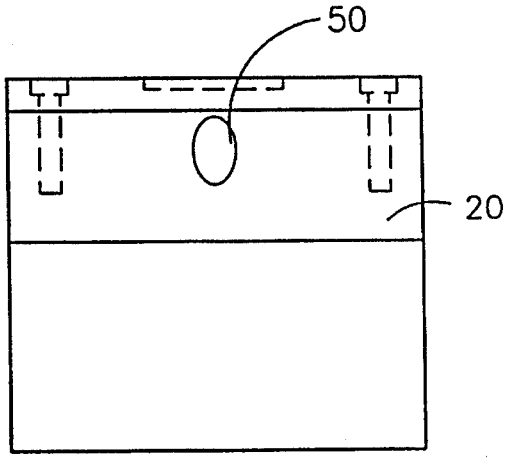
FIG. 4 is a cross-sectional view taken along line A'—A' of FIG. 1.
Figure 5:
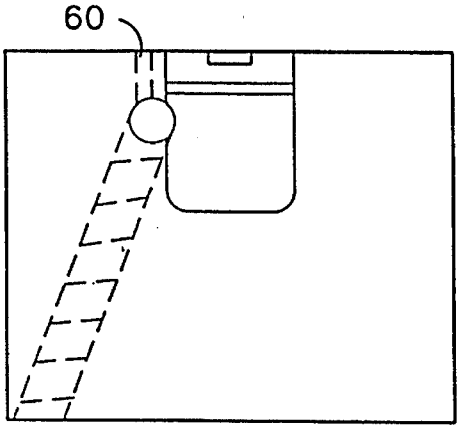
FIG. 5 is a cross-sectional view taken along line B—B of FIG. 1.

With reference to FIGS. 3 and 4, the retainer block 20 is housed in a recess 32 of a body portion 30. The body portion 30 includes a locking means to hold the retainer block 20 in place. One embodiment incorporates a locking ball 42 and spring 40 as the locking means. FIG. 4 shows a machined dimple 50 in the retainer block 20 which allows for the partial insertion of the locking ball 42. Referring to FIG. 5, an access hole 60 is provided in the body portion 30 for the insertion of a rod to disengage the locking ball 42 from the retainer block 20.

An innovative method of marking indica on a manufactured part and then quickly changing said indicia will now be described. The process begins by loading a first set of indica or type members 16 into the recess 14 in a first stamp retainer 10. Next, the first stamp retainer is fixed into a recess 32 in a body portion 30 of the marking device 8. Next, the associated manufactured part is marked by bringing the first set of indicia 16 into contact with a surface (not shown) of the associated manufactured part (not shown). When the indica need to be changed, the first retainer block 20 is removed from the recess 32 in the body portion 30. Next, a second set of indica (not shown) into a recess (not shown) in a second stamp retainer (not shown). Next this second retainer block is loaded into the recess of the body portion. A second associated manufactured part can be marked by bringing said second set of indicia into contact with a surface of the second associated manufactured part. The first retainer block is removed by inserting a rod into an access channel 60 of the body portion 30 of the marking device 8, thereby disengaging the ball and spring locking mechanism. The step of loading a second set of indica into the recess in the second stamp retainer is performed while the first set of indicia is being used to mark said associated manufactured part. This process saves time, since the indicia can be preloaded into the second stamp retainer while the first stamp retainer is still being used.

The present invention has been described with reference to the preferred embodiment. Obviously, modifications and alterations will occur to others upon a reading and understanding of the specification. It is intended by the applicant to include all such modifications and alterations insofar as the come within the scope of the appended claims or the equivalents thereof. Having thus described the invention, it is now claimed:

I claim:

1. A marking device comprising:

a body portion, said body portion having a recess;

a retainer block, said retainer block selectively fitting into said recess of said body portion;

a stamp retainer, said stamp retainer having a recess;

type members, said type members selectively fitting into said recess in said stamp retainer;

attaching means for attaching said stamp retainer to said retainer block;

a locking means for locking said retainer block into said recess of said body portion, said locking means being engaged by a unidirectional motion of said retainer block relative to said body portion.

2. The marking device of claim 1 wherein said locking means is a ball and spring combination.

3. The marking device of claim 2 wherein said retainer block further comprises:

a dimple, said dimple providing for the partial insertion of said ball.

4. The marking device of claim 1 wherein said body portion further comprises:

an access channel, said access channel providing access to an associated tool to disengage said locking means.

5. The marking device of claim 1 said attaching means comprises:

set screws, said stamp retainer being attached to said retainer block by said set screws.

6. A method of marking indicia on a manufactured part and then quickly and easily changing said indicia, said marking indicia being received within a recess in stamp retainers which in turn are attached to retainer blocks, said retainer blocks being received within a recess in a body portion of a marking device, said method comprising the steps of:

loading a first set of indicia into a recess in a first stamp retainer;

attaching said first stamp retainer to a first retainer block;

locking said first retainer block into a recess in a body portion of said marking device by pushing said first retainer block towards said body portion with a unidirectional motion;

marking the associated manufactured part by bringing said first set of indicia into contact with a surface of the associated manufactured part;

disengaging and removing said first retainer block from said recess in said body portion;

loading a second set of indicia into a recess in a second stamp retainer;

attaching said second stamp retainer to a second retainer block;

locking said second retainer block into said recess of said body portion by pushing said second retainer block towards said body portion with a unidirectional motion; and, marking a second associated manufactured part by bringing said second set of indicia into contact with a surface of the second associated manufactured part.

7. The method of claim 6 wherein said step of disengaging and removing said first retainer block from said recess in said body portion includes inserting an associated tool into an access channel of said body portion of said marking device, thereby disengaging a ball and spring locking mechanism.

8. The method of claim 7 wherein said steps of loading a second set of indicia into a recess in a second stamp retainer and attaching said second stamp retainer to a second retainer block are performed while said first set of indicia is being used to mark said associated manufactured part.

* * * * *